United States Patent [19]

Stein

[11] 4,065,196

[45] Dec. 27, 1977

[54] POSITIVE ACTION FRONT RELEASE DRAWER SLIDE ASSEMBLY

[75] Inventor: Robert R. Stein, Mount Kisco, N.Y.

[73] Assignee: Hardware Designers, Inc., Mount Kisco, N.Y.

[21] Appl. No.: 738,586

[22] Filed: Nov. 3, 1976

Related U.S. Application Data

[63] Continuation-in-part of Ser. No. 654,238, Feb. 2, 1976, Pat. No. 3,995,927.

[51] Int. Cl.[2] ..... A47B 88/16; F16C 21/00

[52] U.S. Cl. ..... 312/333; 312/341 R; 312/348; 308/3.8

[58] Field of Search ..... 312/333, 341, 348, 346, 312/350, 348 NR; 308/3.6, 3.8

[56] References Cited

U.S. PATENT DOCUMENTS

| | | | |
|---|---|---|---|
| 3,123,419 | 3/1964 | Maxwell | 312/333 |
| 3,142,517 | 7/1964 | Ward | 312/341 NR |
| 3,243,247 | 3/1966 | Knappe | 312/333 |
| 3,328,106 | 6/1967 | Mullin | 312/341 R |
| 3,701,577 | 10/1972 | Fischer | 312/348 |

*Primary Examiner*—Paul R. Gilliam
*Assistant Examiner*—Victor N. Sakran
*Attorney, Agent, or Firm*—Mark T. Basseches; Paula T. Basseches

[57] ABSTRACT

The present invention is directed to improvements in the art of drawer suspensions, and particularly relates to an improved front release drawer suspension of the type employed for slidably supporting a drawer within a cabinet while permitting the drawer to be bodily removed when the same reaches an outwardmost limiting position relative to the cabinet. The drawer slide assembly includes a release member carried by the drawer, the release member being accessible from the front of the unit at the outermost limiting position of the drawer to facilitate removal of the drawer. The release assembly is characterized by means which positively deflect the forward motion limiting components into engagement as the slide components reach the outermost limiting position and preferably, in addition, permit reinsertion of the drawer without manual activation of the latching mechanism.

8 Claims, 7 Drawing Figures

FIG. 5
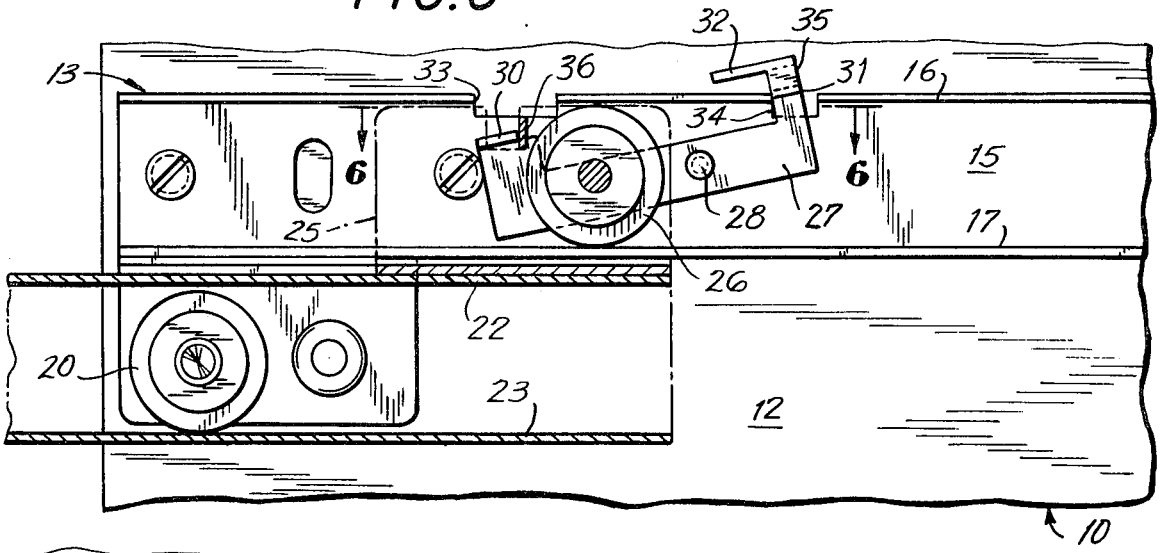
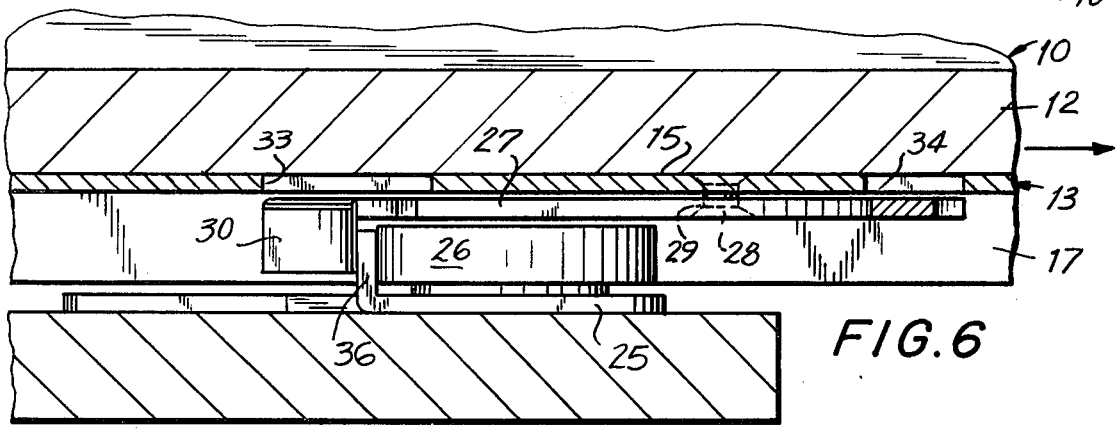
FIG. 6
FIG. 7
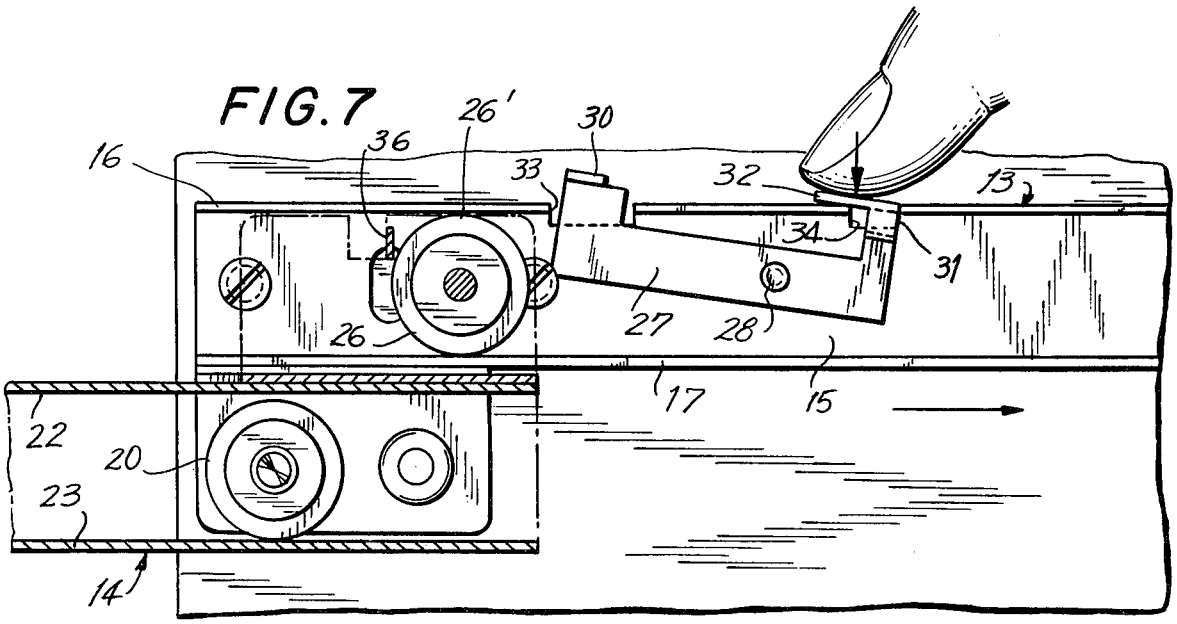

POSITIVE ACTION FRONT RELEASE DRAWER SLIDE ASSEMBLY

This application is a continuation-in-part of my application Ser. No. 654,238, filed Feb. 2, 1976, now U.S. Pat. No. 3,995,927, entitled Front Release Drawer Slide.

BACKGROUND OF THE INVENTION

1. Field of the Invention

The present invention is in the field of drawer suspensions and relates more particularly to a drawer suspension which enables the drawer to be removed when the same is in the fully extended position but which, in addition, locks the drawer against inadvertent removal, and facilitates replacement of the drawer.

2. The Prior Art

In my above referred to pending application, now U.S. Pat. No. 3,995,927, there is disclosed a drawer suspension which includes first and second channel members interconnected by anti-friction means, such as rollers. As is conventional, a said channel member is secured to each side of the drawer and a complemental channel is secured to opposed parallel faces of a cabinet adjacent the drawer, whereby the drawer may slide in and out freely.

As noted in my above referenced patent, means may be provided to block the drawer from being inadvertently pulled clear of the cabinet, with resultant spilling of the contents. Such latching means may include a gravity pawl which, when the drawer channels reach a predetermined relatively extended position, falls into place between the channels and precludes further sliding movement, removal of the drawer requiring manual tripping of the pawls.

Such latch mechanisms possess certain inherent disadvantages. Specifically, since spring or gravitational forces are relied upon as the means for urging the pawl into latching engagement with a stop, accumulations of dirt, or corrosion, or deformation of the parts may create sufficient friction to prevent the pawl from moving into the desired stop position. Should this condition occur, or should the drawer be pulled forward so quickly that the pawl has insufficient time to fall into locking position, the drawer may be pulled entirely clear of the cabinet and the contents spilled.

A further drawback of certain pawl latching units resides in the fact that their operation is dependent upon a stop tooth of the pawl scanning or rubbing against a sliding component of the cabinet channel in the course of normal longitudinal movements of the drawer, a condition which creates chatter or noise during normal extending and retracting movements of the drawer.

Examples of prior art drawer slides having pawl structures of the type described may be found in U.S. Pat. Nos. 3243,247; 3328,106; and other units mentioned in my above referenced United States patent.

SUMMARY

The present invention may be summarized as directed to an improved drawer suspension device having a latching mechanism accessible at the front of the drawer when the same is in its fully extended position relative to the cabinet. The suspension in accordance with the invention includes at each side of the drawer to be suspended a pair of elongate channels fixed relatively to the drawer and a parallel adjacent cabinet component. Each of the channels, as is conventional, includes a track and an anti-friction roller, the roller of each said channel riding on the track of the other.

The drawer channel includes a latching assembly adjacent the rear end thereof, the device being characterized by components of the latching assembly being disposed in the path of the roller mounted to the cabinet assembly. The positions of the pawl and the noted roller are coordinated in such manner that a latching tooth or portion of the pawl is positively projected into engagement with a stop portion on the cabinet channel as the drawer approaches its fully withdrawn position, whereby the drawer may not be inadvertently pulled clear of the cabinet even if the means with the movable connection between the pawl and the drawer channel becomes fouled or corroded, increasing the forces required to effect such movements.

The device is further characterized by the pawl, in its normal operative position, being clear of any scanning or wiping contact with the cabinet channel, whereby relatively noiseless suspension is achieved, and by a simplified procedure for remounting the drawer.

It is accordingly an object of the invention to provide an improved front release drawer suspension assembly.

It is a further object of the invention to provide a drawer suspension assembly of the type described wherein the means which latches the drawer channel to the cabinet channel is positively projected into position responsive to a predetermined longitudinal relative movement of said channels.

A further object of the invention is the provision of an improved drawer slide assembly of the type described wherein the stationary anti-friction means or roller carried by the cabinet channel is disposed in the path of the pawl which is carried by the drawer channel, and coacts with said pawl to assure the projection of the latter into latching engagement of the channels at a position corresponding to the fully extended position of the drawer.

Still a further object of the invention is the provision of a drawer suspension assembly of the type described wherein the pawl mechanism which effects latching at the terminal end of the drawer withdrawing stroke is clear of any connection with the cabinet channel, resulting in a more silent operation as contrasted with assemblies of the type described heretofore known.

Still a further object of the invention is the provision of a drawer suspension of the type described wherein the cabinet supported roller is positioned to coact with the pawl on remounting of the drawer, to permit the channels to be reassembled without manual activation of the pawls.

To attain these objects and such further objects as may appear herein or be hereinafter pointed out, reference is made to the accompanying drawings, forming a part hereof, in which:

FIG. 5 is a view similar to FIG. 2, showing the position of the parts in the fully extended position of the drawer;

FIG. 6 is a magnified view taken on the line 6—6 of FIG. 5;

FIG. 7 is a view similar to FIGS. 2 and 5, showing the position of the parts following removal of the drawer.

Figure 1:
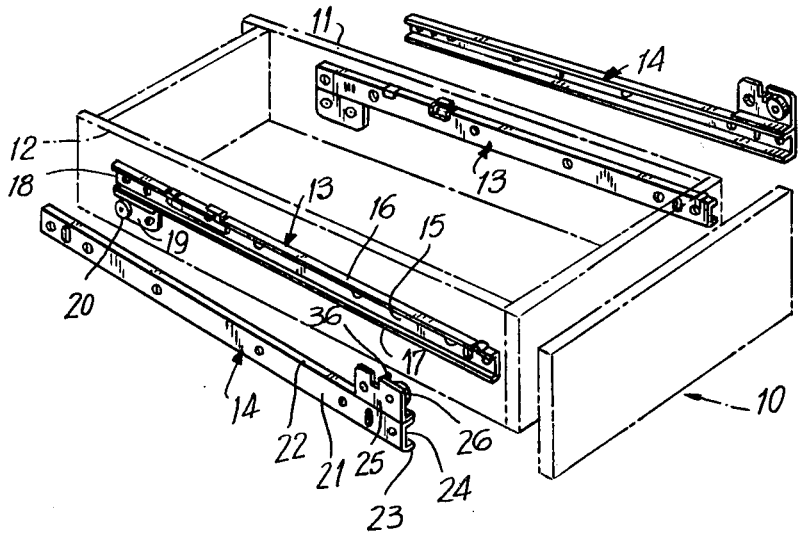
FIG. 1 is an exploded perspective view of a drawer assembly illustrated in conjunction with the suspension system in accordance with the invention.

Turning now to the drawings, there is shown in FIG. 1 a drawer assembly including a drawer 10, depicted in broken lines, having side panels 11 and 12. Each said side panel has affixed thereto an elongate movable channel 13, 13 of a suspension system, the other component of the suspension system being an elongate channel 14, 14 intended to be fixed to the wall portions of the cabinet adjacent the sides 11, 12.

It will be appreciated that the function of the suspension system is to permit the drawer to be extended and returned to its position within the cabinet quietly and with a minimum of friction. The suspension of the present invention is also intended to prevent the drawer from being inadvertently pulled outwardly from the cabinet to a completely disengaged position, yet to permit facile removal of the drawer by an appropriate manipulation, as hereinbefore more fully described.

Figure 4:
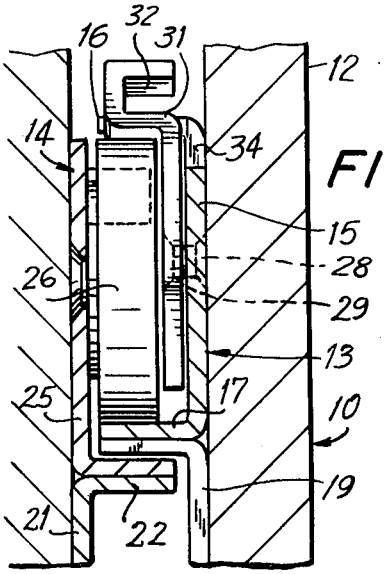
FIG. 4 is a sectional view taken on the line 4—4 of FIG. 3.

The drawer supported channel 13 is U-shaped in transverse section and, as best seen in FIGS. 1 and 4, includes a central web 15, an upper and a lower track 16, 17, respectively. The channel 13, adjacent its rearward end 18 includes a depending bracket 19 carrying a laterally off-set roller member 20.

The channel 14, which is likewise U-shaped in transverse section, includes a central web 21, upper and lower tracks 22, 23, and has at its forward end 24 an upwardly directed bracket 25. A roller 26 extends laterally inwardly from the bracket.

It will be understood that upon assembly of the channels, the roller 20 of the drawer channel 13 will enter the channel 14 and ride upon the lower track 23 thereof, and roller 26 of the cabinet channel 14 will enter channel 13 and ride upon the track 17 thereof, to provide relatively frictionless forward and rearward translatory movement of the drawer within its supporting cabinet.

The suspension assembly as thus far described is essentially conventional.

The principal advance of the present invention resides in the latching mechanism which prevents inadvertent outward removal of the drawer and assures that the components which control such removal are positively set to their latched position as the drawer approaches its outward limiting position.

The latch mechanism includes a pawl member 27 supported on the drawer slide 13 at a rearward position therealong, the pawl being pivotally mounted on a stud member 28 extending into the channel. The pawl includes a throughgoing aperture 29 which surrounds the stud 28, enabling a limited rocking movement of the pawl. The pawl includes a horizontally directed latch portion 30 at a rearward end and a horizontal activator portion 31 adjacent its forward or outward end. The pawl, in addition, includes a trip or release portion 32 adjacent the activator portion 31.

The upper track 16 of the drawer channel 13 includes rear clearance slot 33 in alignment with latch portion 30 and a forward clearance slot 34, through which extends an upwardly directed connector portion 35 of the pawl, the connector portion linking the trip or release portion 32 with activator portion 31.

Figure 2:
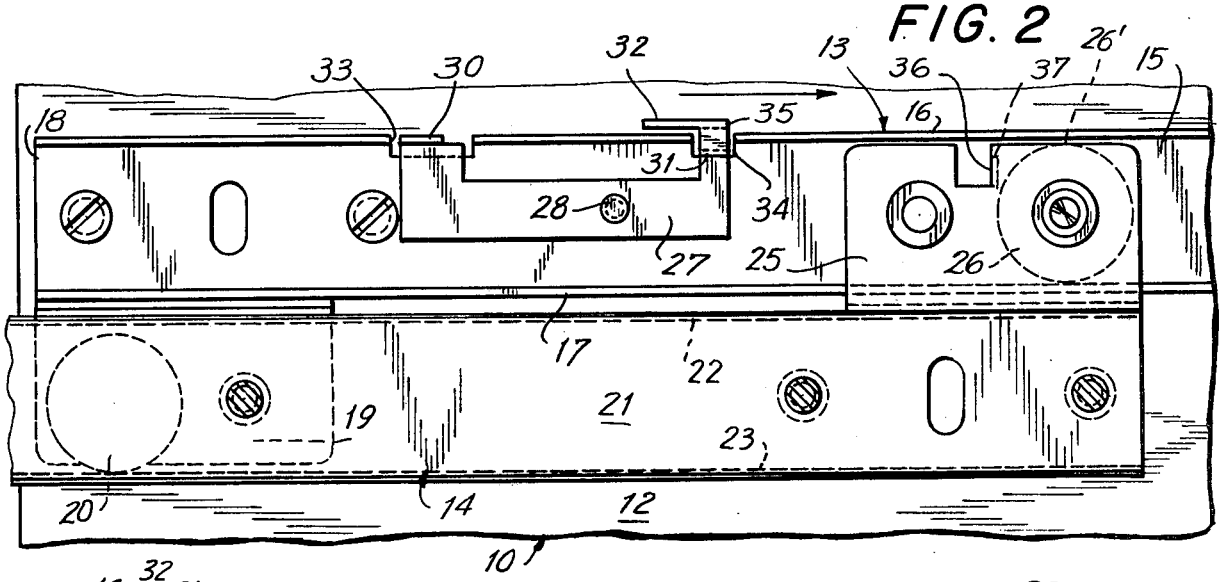
FIG. 2 is a vertical sectional view through a suspension in accordance with the invention, illustrating the components at a partially withdrawn position of the drawer.

As best seen in FIGS. 2 and 4, the release portion 32 overlies the top rail 16, limiting clockwise movement of the pawl. In similar fashion, since the body of the pawl underlies the track 16, anti-clockwise pivotal movement of the pawl is limited by engagement of the body of the pawl against portions of the track 16. It will thus be seen that the pawl is provided with a limited range of pivotal movement about the stud 28, the anti-clockwise and clockwise limiting positions of the pawl being illustrated, respectively, in FIGS. 3 and 7.

The bracket 25 of the cabinet channel 14 includes a stop tab member 36 which extends into the drawer channel 13 in leading position relative to the roller 26. It will be observed from FIG. 2 that the upper peripheral edge 26′ of the roller 26 extends to a height slightly above the height of the uppermost edge 37 of the stop tab member 36. When the pawl 27 is pivoted in such manner that the latch portion 30 is downwardly disposed, FIG. 3, the outwardly extending latch portion 30 will be positioned in the path of the inwardly bent stop tab 36 of bracket 25.

This position of the parts is shown in FIG. 5 wherein it can be clearly perceived that further outward movements of the drawer carried channel 13 are prevented by engagement of the portions 30 of the pawl and stop tab member 36 of the bracket 25 carried by the cabinet channel.

It will be further recognized that to complete removal of the drawer, it will be necessary to depress the release portion 32 of the pawl so as to lift the pawl in a clockwise direction, lifting the latch 30 of the pawl to a level above the stop 36 of the bracket (see FIG. 5), whereupon the drawer may be manually removed.

Figure 3:
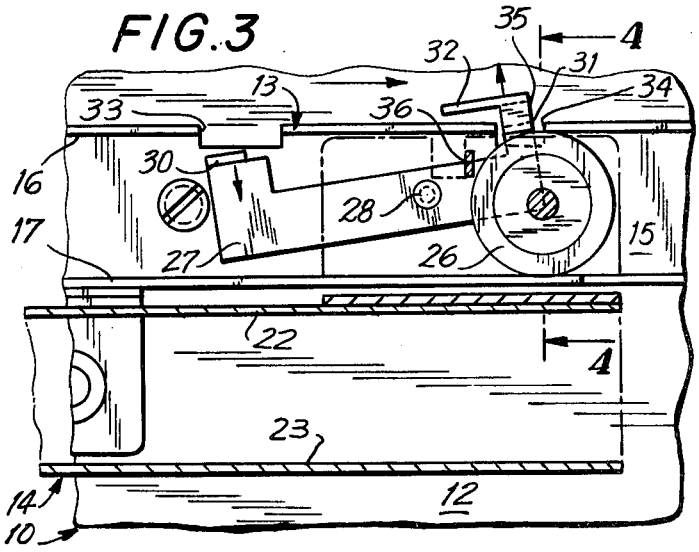
FIG. 3 is a vertical sectional view similar to FIG. 2, showing the position of the parts as the drawer approaches the fully extended position.

Preferably, the pawl 27 is weighted in such manner as to be maintained under gravitational influences in the anti-clockwise position shown in FIGS. 3 and 5. So long as the pawl is thus positioned, the latch portion will lie in the path of the stop 36 and an outward pulling force exerted on the drawer will be ineffective to pull the drawer clear of the cabinet without manual activation of the pawl 27 in the manner indicated.

A problem exists, however, where, as a result of the accumulation of detritus, corrosion, or deformation of the parts, the pawl 27 does not freely pivot about the stud 28. Should such condition or some other condition which precludes fee pivoting movement of the pawl develop, and the pawl resist gravitational forces tending to move the same to the position of FIG. 3, it is possible that the drawer could inadvertently be withdrawn completely from the cabinet. Since pulling forces on the drawer are typically exerted at the lead or outermost end of the drawer, it would be obvious that, should the drawer be pulled free, the contents of the drawer would be spilled.

The principal advance of the present invention resides in the provision of means for assuring that the pawl will be disposed in the position shown in FIG. 3, i.e. counter-clockwise rotated. This function is provided by a disposition of activator portion 31 in the path of an upper peripheral portion 26′ of the roller 26.

As will be observed from a comparison of FIGS. 2 and 3, if the pawl should be jammed in the clock-wise rotated position shown in FIG. 2, the activator portion 31, although at a level above the stop portion 36, will be engaged by a peripheral portion 26′ of the roller 26 and positively tilted to the desired anti-clockwise position whereat the latch portion 30 is depressed into the path of the stop 36 (the FIG. 3 position.) In FIG. 3, the activator portion is shown in engagement with a peripheral portion of the roller 26.

Complete removal of the drawer, as previously noted, is effected by manually depressing the portions 32 of the respective suspension assemblies to the position shown in FIG. 7, whereat the latches 30 are raised to a position above the stops 36. Return of the drawer following removal may be effected by placing roller 26 in the rear end of channel 13 and sliding the drawer inwardly. Replacement of the drawer is facilitated since the pawl 27 need not be manually activated, the roller, upon inward movement, serving to lift and cam the latch 30 of the pawl over the roller and stop tab 36. The lengthwise or horizontal extent of the latch 30 is greater than the spacing of tab 36 from the roller periphery so that the latch 30 cannot fall into the path of the stop tab 36 until the latch 30 has passed inwardly over tab 36.

In view of the positive interaction of the roller and pawl whereby the latter is automatically set upon withdrawal of the drawer and returned to latching position upon reinsertion of the drawer due to the roller 26 again lifting activator 31, the use of a gravity pawl is not mandatory. Indeed, there are instances in which it may be preferred that the pawl not freely rotate about the stud, e.g. that a friction clutch be interposed between the noted parts.

It will be further observed that, unlike my above referenced copending application, no portion of the pawl structure carried by the drawer engages against any portion of the cabinet structure during normal translatory movement of the drawer within the cabinet. Thus, even the slight scraping sounds experienced in the use of the prior device are eliminated in the present construction.

It will be readily recognized in the light of the above disclosure that variations may be made in details of the construction without departing from the spirit of the invention which, in its broadest aspects, is considered to reside in the use of trip means interposed between the respective moving channels, which assure that a moving pawl or slide is positively shifted to its locking or drawer removal blocking position responsive to relative outward movement of the channel components, and lifted to facilitate reinsertion of the drawer.

It will be appreciated that certain of the advantages of the invention may be retaining by reversing the positions of elements to be mounted to the respective channels. Accordingly, the invention is to be broadly construed within the scope of the appended claims.

Having thus described the invention and illustrated its use, what is claimed as new and is desired to be secured by Letters Patent is:

1. A front removable drawer slide assembly comprising, in combination, a drawer channel and a cabinet channel, said channels being elongate and generally U-shaped in transverse section, said channels each including a central web defining the branch of said U and a pair of spaced parallel track portions extending from the extremities of said branch and defining the legs of said U, said channels being disposed in vertically stacked parallel relation, with said webs being in lateral offset vertical planes and said branches extending in opposite directions, with the lower branch of the upper channel being in proximate spaced relation to the upper branch of the lower channel, an anti-friction roller mounted adjacent an extremity of each said channel, said rollers extending into the other said channels for slidably supporting said channels for translatory movement, a latch member movably mounted on one said channel, said latch member being shiftable between locking and unlocking positions, a stop member on the other said channel positioned to engage said latch member in the locking position thereof and limit separating movements of said channels, said latch member, in the unlocking position thereof, being disposed in the path of said roller of said other channel and being shifted to said locking position responsive to engagement with said roller.

2. A drawer slide in accordance with claim 1 wherein said latch member comprises a pawl pivotally mounted on said one channel.

3. A drawer slide in accordance with claim 2 wherein said pawl includes a latch portion adapted to engage said stop member, and an activator portion disposed in the path of said roller.

4. A drawer slide in accordance with claim 3 wherein said pawl includes a release portion extending outwardly of said one channel whereby said pawl may be shifted from said locking to said unlocking positions by manipulation of said trip portion.

5. A drawer slide in accordance with claim 4 wherein said pawl is gravitationally urged toward said locking position.

6. A drawer slide in accordance with claim 4 wherein said one channel is said drawer channel.

7. A drawer slide in accordance with claim 4 wherein said roller member of said other channel is positioned to engage said latch portion of said pawl and shift said pawl to said unlatching position responsive to longitudinal relative movements of said channels from the disassembled to the assembled condition.

8. A front removable drawer slide assembly comprising, in combination, a drawer channel and a cabinet channel, said channels being elongate and generally U-shaped in transverse section, said channels each including a central web defining the branch of said U and a pair of spaced parallel track portions extending from the extremities of said branch and defining the legs of said U, said channels being disposed in vertically stacked parallel relation, with said webs being in lateral offset vertical planes and said branches extending in opposite directions, with the lower branch of the upper channel being in proximate spaced relation to the upper branch of the lower channel, an anti-friction roller mounted adjacent an extremity of each said channel, said rollers extending into the other said channels for slidably supporting said channels for translatory movement, a latch member movably mounted on one said channel, said latch member being shiftable between locking and unlocking positions, a stop member on the other said channel positioned to engage said latch member in the locking position thereof and limit separating movements of said channels, and means on said other channel in the path of said latch member for shifting said latch member from said unlocking to said locking position responsive to predetermined relative longitudinal movement of said channels.

* * * * *